US011832689B2

(12) United States Patent
Dyckmans et al.

(10) Patent No.: US 11,832,689 B2
(45) Date of Patent: Dec. 5, 2023

(54) METHOD FOR PLACING OF COMPONENTS

(71) Applicant: adidas AG, Herzogenaurach (DE)

(72) Inventors: Clemens Dyckmans, Erlangen (DE); Thomas Feix, Herzogenaurach (DE); Andreas Kugi, Vienna (AT); Tobias Glück, Vienna (AT); Christian Hartl-Nesic, Vienna (AT)

(73) Assignee: adidas AG, Herzogenaurach (DE)

( * ) Notice: Subject to any disclaimer, the term of this patent is extended or adjusted under 35 U.S.C. 154(b) by 77 days.

(21) Appl. No.: 16/752,558

(22) Filed: Jan. 24, 2020

(65) Prior Publication Data

US 2020/0237053 A1 Jul. 30, 2020

(30) Foreign Application Priority Data

Jan. 25, 2019 (DE) ..... 102019200979.4

(51) Int. Cl.
*A43D 8/44* (2006.01)
*A43B 3/00* (2022.01)

(52) U.S. Cl.
CPC ..... *A43D 8/44* (2013.01); *A43B 3/0078* (2013.01)

(58) Field of Classification Search
CPC ... A43D 3/02; A43D 8/00; A43D 8/44; A43D 11/006; A43D 11/01; A43D 25/00; A43D 25/047; A43D 25/053; A43D 25/07; A43D 25/18; A43D 111/003; A43B 3/0078; B65C 3/26; B65C 9/1803; B65C 9/18; B65C 9/32
USPC ..... 36/136
See application file for complete search history.

(56) References Cited

U.S. PATENT DOCUMENTS 3,107,376 A * 10/1963 Reid ..... A43D 11/006 12/1 R
3,325,335 A 6/1967 Martensson
4,275,856 A 6/1981 Harvey
4,377,876 A * 3/1983 Berrill ..... A43D 25/183 118/315
5,968,297 A * 10/1999 Hooker ..... A43D 25/183 156/64
7,089,691 B1 8/2006 Silvera
(Continued)

FOREIGN PATENT DOCUMENTS

CN 106937775 A 7/2017
CN 107028285 8/2017
(Continued)

OTHER PUBLICATIONS

Chinese Application No. 202010069488.9, Office Action dated Jul. 14, 2021, 8 pages (4 pages of Original Document and 4 pages of English Translation).
(Continued)

*Primary Examiner* — Aiying Zhao
(74) *Attorney, Agent, or Firm* — Kilpatrick Townsend & Stockton LLP

(57) ABSTRACT

A method for the manufacture of a sports article, in particular a sport shoe, can include the operations of: (a) providing at least one laminar component; (b) providing at least one three-dimensional object; and (c) placing the component onto the object by means of a first roll while simultaneously moving the object relative to the roll.

10 Claims, 12 Drawing Sheets

(56) References Cited

U.S. PATENT DOCUMENTS

| | | | | |
|---|---|---|---|---|
| 2009/0133815 | A1* | 5/2009 | Okuno | B65C 9/1884 156/238 |
| 2010/0084083 | A1 | 4/2010 | Hull et al. | |
| 2011/0100557 | A1* | 5/2011 | Cooper | B65C 9/18 156/510 |
| 2013/0340946 | A1* | 12/2013 | Frank | C09J 7/00 156/540 |
| 2014/0250734 | A1 | 9/2014 | Zheng | |
| 2014/0318700 | A1* | 10/2014 | Henderson | B65C 9/1869 156/767 |
| 2017/0188664 | A1* | 7/2017 | Manz | A43D 8/02 |

FOREIGN PATENT DOCUMENTS

| | | | | |
|---|---|---|---|---|
| CN | 107108062 | | 8/2017 | |
| CN | 207912200 | | 9/2018 | |
| DE | B33315 | | 8/1956 | |
| DE | 2926684 | | 1/1980 | |
| DE | 2916523 | A1 | 10/1980 | |
| DE | 8805900 | | 6/1988 | |
| DE | 102014002287 | | 8/2015 | |
| EP | 1777052 | | 4/2007 | |
| EP | 2043474 | B1 * | 1/2012 | A43D 25/181 |
| EP | 2865289 | | 4/2015 | |
| EP | 3178342 | | 6/2017 | |
| WO | 0024285 | | 5/2000 | |

OTHER PUBLICATIONS

German Patent Application No. 102019200979.4, Office Action dated Jun. 8, 2019, 14 pages (English machine translation submitted).

Chinese Patent Application No. 202010069488.9, Office Action, dated Feb. 26, 2021, 16 pages (English machine translation provided).

European Patent Application No. 20153581.2, Partial European Search Report dated Jun. 22, 2020, 15 pages.

Kim et al., "Robot-Based Shoe Manufacturing System", 18th International Conference on Control, Automation and Systems, Institute of Control, Robotics and Systems, Oct. 17-20, 2018, pp. 1491-1494.

Chinese Application No. 202010069488.9, Office Action dated Oct. 20, 2021, 9 pages (English machine translation provided).

Chinese Patent Application No. 202010069488.9, Notification to Grant Patent Right for Invention, dated Feb. 8, 2022, 3 pages (1 page original document; 2 pages English translation).

European Patent Application No. 20153581.2, Extended European Search Report, dated Sep. 29, 2020, 13 pages.

German Patent Application No. 102019200979.4, Office Action, dated Jul. 7, 2022, 10 pages (5 pages original document; 5 pages English translation.

Office Action, European Patent Application No. 20153581.2, dated Jan. 31, 2023, 7 pages.

* cited by examiner

METHOD FOR PLACING OF COMPONENTS

CROSS REFERENCE TO RELATED APPLICATION

This application is related to and claims priority benefits from German Patent Application No. DE102019200979.4, filed on Jan. 25, 2019, entitled METHOD FOR PLACING OF COMPONENTS ("the '979 application"). The '979 application is hereby incorporated herein in its entirety by this reference.

FIELD OF THE INVENTION

The present invention relates to a method for the manufacture of sporting goods, in particular shoes.

BACKGROUND

In manufacturing processes for sports articles, such as sports shoes, components may be placed on each other. For examples, patches, reinforcements, and logos may be placed on a shoe upper and may be welded, sewn, or glued to the shoe upper. The components may be placed manually or automatically by a gripper or robot arm. If the components are placed automatically, the sport article, or a part thereof, is usually in a flat or two-dimensional configuration. For example, components may be placed on a shoe upper before the upper is closed, lasted, and connected to a shoe sole.

It is desirable to be able to place components on three-dimensional objects in order to manufacture sports articles. This would generally overcome disadvantages associated with placing components on two-dimensional objects and subsequently forming the object into a three-dimensional object. For example, patches, reinforcements, and logos placed on a two-dimensional shoe upper tend to buckle when the shoe upper is lasted. In addition, no process steps are needed to create a three-dimensional object from a two-dimensional material. This also offers benefits regarding fit and comfort as seams can be avoided which would otherwise be required. Finally, being able to place components on three-dimensional objects allows for product modifications very late in the process, potentially in-store.

EP3178342 mentions placing patches on a three-dimensional surface without discussing a specific apparatus or method for dispensing the patch material or transporting it to the shoe upper.

EP2865289 mentions a processing station that is provided to connect the second shoe component with the three-dimensionally pre-shaped first shoe component by gluing or welding.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various embodiments of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

According to certain embodiments, a method for manufacture of a sports article, in particular a sports shoe, includes providing at least one laminar component and at least one three-dimensional object. The method may further include placing the at least one laminar component onto the at least one three-dimensional object via a first roll, while the three-dimensional object is simultaneously moved relative to the first roll.

In some embodiments, the method further includes placing the laminar component on a conveyor belt. The first roll may be a pulley of the conveyor belt and the conveyor belt may convey the laminar component to the first roll. The conveyor belt may be compliant.

In some embodiments, the method further includes pressing the laminar component in a direction of the first roll.

In some embodiments, the providing of the laminar component includes providing the laminar component on a liner. The method may further include guiding the liner over the first roll such that the laminar component separates from the liner. Moreover, the method may include guiding the liner over a second roll such that the laminar component separates from the liner and is transferred to the first roll.

In some embodiments, the first roll is compliant.

According to certain embodiments, a method for manufacture of a sports article, in particular a sports shoe, includes providing at least one laminar component on a liner, providing at least one three-dimensional object, and placing the laminar component onto the three-dimensional object by transferring the laminar component from the liner to the object.

In some embodiments, the placing of the laminar component includes pushing the laminar component in a direction of the object. The pushing of the laminar component may include pushing the laminar component via an air blast such that the laminar component is placed onto the three-dimensional object.

In some embodiments, the method further includes holding the laminar component by low pressure before it is placed onto the three-dimensional object.

In some embodiments, the method further includes peeling off the laminar component from the liner before pushing the laminar component.

In some embodiments, the method further includes pushing the liner in the direction of the three-dimensional object such that the laminar object is transferred from the liner onto the three-dimensional object.

In some embodiments, the liner is air permeable and the method further comprises pushing the laminar component into the direction of the three-dimensional object via an air blast such that the laminar component separates from the liner and is placed onto the three-dimensional object.

In some embodiments, the method further includes placing the laminar component on a robot arm. The first roll may be mounted on the robot arm. The laminar component may include an adhesive and the three dimensional object may be a shoe last. The three dimensional object may be a pre-formed component of the sports article.

BRIEF DESCRIPTION OF THE DRAWINGS

In the following detailed description, embodiments of the invention are described referring to the following figures.

BRIEF DESCRIPTION

Figure 1A:
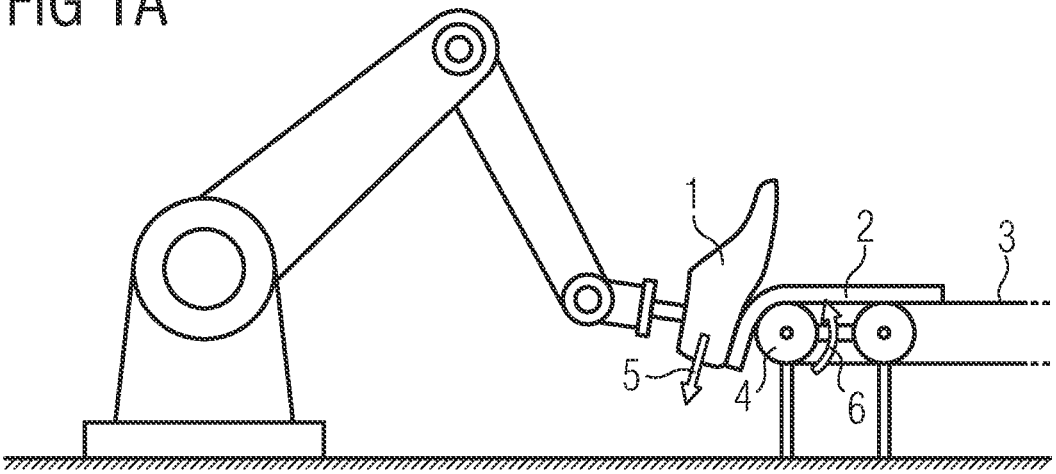
FIGS. 1A-1D are side views showing examples of components that may be used in a method according to embodiments.

Therefore, it is the objective of some embodiments to provide a method for the manufacture of sports articles that allows for substantially automating the manufacturing process while avoiding—or at least reducing—loss of quality.

This objective is met by a method for the manufacture of a sports article, in particular a sport shoe, comprising the operations of (a.) providing at least one laminar component; (b.) providing at least one three-dimensional object; and (c.) placing the component onto the object via a first roll while simultaneously moving the object relative to the roll.

The laminar component may, for example, be a patch to be placed on a three-dimensional shoe upper, for example, on a lasted shoe upper. The roll helps to press the laminar component against the three-dimensional object. To assert this pressure over the entire length of the laminar component, the object may be moved relative to the roll so that the roll rotates. In this way, the laminar component may be firmly placed onto the three-dimensional object. The roll may closely follow the contour of the surface of the three-dimensional component so that the contact pressure is substantially the same along the entire length of the laminar component. In this way, the component may be placed both on convex and concave portions of the three-dimensional surface.

It should be noted that some embodiments may be applied to manufacturing any kind of sports articles including footwear, apparel, accessories, balls, etc. For example, some embodiments may be used to attach reinforcing patches to garments, such as sports bras.

The method may further comprise the operation of placing the component on a conveyor belt. This allows for the processing of a number of components so as to either place multiple components onto the object and/or to apply components to multiple objects.

The first roll, also known as a contact roll, may be a pulley of the conveyor belt. Thus, the first roll may simultaneously support transporting the component and placing the component onto the object. As the component is directly supplied from the conveyor belt to the object, the risk of the component getting stuck may be minimized.

The conveyor belt may convey the component to the first roll. In this way, multiple components may be fed to the roll and placed onto the object and/or at least one component may be placed onto multiple objects.

The conveyor belt may be compliant. A compliant conveyor belt may yield so as to adapt to the surface contours of the object onto which the component is to be placed. As such, the compliant conveyor belt may comprise a comparable soft surface.

The method may further comprise the operation of pressing the component in the direction of the first roll. This may include using a clamping roll and/or an airflow. This may avoid the potential that the laminar component is unintentionally lifted off the first roll or the conveyor belt when it is pressed against the object. Thus, this measure is especially useful for long and/or stiff laminar components, and/or three-dimensional objects with high curvature. Additionally, a clamping roll and/or an air-flow may allow exertion of tangential tension to the component during application.

The operation of providing the component may comprise providing the component on a liner. The component may adhere to the liner, thus forming an adhesive tape. Using a liner simplifies handling of the component, or components, as these may be cut from an endless roll of adhesive tape. Additionally, a liner increases the placement accuracy since components are generally transported in a defined manner. Generally, the adhesive force between the component and the liner may be substantially lower than the adhesive force between the component and the object. In this way, the component may easily be separated from the liner before it is placed onto the object, yet the bond between the component and the object may be sufficiently large.

The method may further comprise the operation of guiding the liner over the first roll, such that the component separates from the liner. In this way, the liner may protect the adhesive side of the component until immediately before the component is placed onto the object. This avoids, for example, dust from adhering to the adhesive side of the component which could undesirably reduce its adhesive force. In addition, the movement of the component caused by the first roll may be used to separate the liner and the component, for example, by a blade and/or by winding up the liner on a roll. In this way, an additional mechanism for separating the component and the liner may be dispensed with.

The method may further comprise the operation of guiding the liner over a second roll, such that the component separates from the liner and is transferred to the first roll. This mechanism allows for separation of the liner and the component while the component is fed to the first roll. The adhesive side of the component may be protected as long as possible.

The first roll may be compliant. A compliant roll may yield so as to adapt to the surface contours of the object onto which the component is to be placed. As such, the compliant roll may comprise a comparable soft surface.

The objective underlying some embodiments is also met by a method for the manufacture of a sports article, in particular a sport shoe, comprising the operations of (a.) providing at least one laminar component on a liner; (b.) providing at least one three-dimensional object; and (c.) placing the component onto the object by transferring the component from the liner onto the object.

In some embodiments, the component may be accurately positioned over the surface of the three-dimensional object while still being held by the liner. In particular, the component may be positioned substantially parallel to the surface of the three-dimensional object, even in convex or concave regions, and then the component may be placed onto the object. In addition, using a liner simplifies handling of the component or components as these may be cut from an endless roll of adhesive tape. Generally, the adhesive force between the component and the liner may be substantially lower than the adhesive force between the component and the object. In this way, the component may easily be separated from the liner before it is placed onto the object, yet the bond between the component and the object may be sufficiently large.

The operation of placing the component may comprise pushing the component into the direction of the object. In this way, the component may be separated from the liner and placed onto the object.

The method may further comprise the operation of pushing the component into the direction of the object via an air blast, such that the component is placed onto the object. Using an air blast is beneficial as it allows for quick acceleration of the component towards the object, such that a plurality of components may be placed at high frequency, thus decreasing the production time. Furthermore, the air blast may apply pressure to the component, once the component has been placed onto the object. In this way, the adhesive bond between the component and the object may be improved. In addition, the pressure exerted by the air blast may help to conform the component to the surface of the object, for example, in convex or concave regions.

The method may further comprise the operation of holding the component by low pressure before it is placed onto the object. Thus, the component may be handled and correctly positioned over the surface of the object before it is applied thereto.

The method may further comprise the operation of peeling off the component from the liner before pushing the component. In this way, the air blast may not need to generate the force required to separate the component from the liner. Instead, the entire energy of the air blast may be used to accelerate the component into the direction of the object and to exert pressure on the component.

The method may further comprise the operation of pushing the liner in the direction of the object, such that the component is transferred from the liner onto the object. In this embodiment, a separate operation of separating the component from the liner, e.g. by peeling off, may be omitted. In this way, the method may be simplified and the frequency of placing components may be increased.

The liner may be air permeable and the method may further comprise pushing the component into the direction of the object via an air blast, such that the component separates from the liner and is placed onto the object. In some embodiments, a separate operation of separating the component from the liner is dispensed with.

Generally, the methods of some embodiments may further comprise the operation of placing the component on a robot arm. The robot arm allows movement of the component in the correct position and orientation before the component is placed onto the object. In some embodiments, the object may rest while the component is placed thereon. For example, a plurality of objects may be transported on a conveyor belt. Each object may be transported to the robot arm, where at least one component is placed thereon.

Generally, according to some embodiments, the first roll may be mounted on a robot arm. As described above, this arrangement allows for a correct positioning and orienting of the component while the three-dimensional object may generally rest.

Generally, according to some embodiments, the component may comprise an adhesive. This allows the component to be placed without additional adhesives to be applied, thus simplifying the method and avoiding additional operations.

Generally, according to some embodiments, the object may be a shoe last. In this way, an upper can be manufactured by placing at least one component onto the shoe last as described herein. It is possible to completely form the three-dimensional upper by placing patches and/or components onto the last avoiding the need for a base material. Alternatively, the upper may be formed via patches placed on a base material while the same is lasted. In any case, as the upper is substantially formed in its final three-dimensional shape, wrinkles, which may appear in prior art methods as described above, may be avoided or at least substantially reduced. In addition, the number of process operations (e.g. forming a three-dimensional upper from a two-dimensional upper) may be reduced and seams can be avoided. Product modifications may be made very late in the process.

Generally, according to the method of some embodiments, the object may be a preformed component of the sports article. For example, the object may be a preformed shoe upper onto which additional reinforcements and logos are placed. As the object already has its final three-dimensional shape, wrinkles may be avoided as described herein.

Some embodiments also relate to a sports article which has been manufactured by use of a method according to some embodiments. Thus, the sports article may generally be manufactured by building up a number of small components (e.g. patches). Alternatively, the sports article may be built up by extruding streams of material.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

In the following, only some possible embodiments of the invention are described in detail. It is to be understood that these exemplary embodiments can be modified in a number of ways and combined with each other whenever compatible and that certain features may be omitted in so far as they appear dispensable.

FIGS. 1A to 1D illustrate examples of a method according to some embodiments. The illustrated method is for the manufacture of a shoe upper for a sports shoe on a last 1. Generally, some embodiments may be applied to the manufacture of other sports articles, such as apparel, or sports balls. For example, some embodiments may be applied to a method of attaching patches to garments, such as sports bras.

In a first operation of some embodiments, at least one laminar component 2 is provided. Generally, in the examples of FIGS. 1A to 1D, the laminar component 2 is provided via a conveyor belt 3. Further examples of providing the laminar component 2 will be described with respect to subsequent figures.

The laminar component 2 in the examples of FIGS. 1A to 1D is a patch that is to be applied to the shoe upper. Such a patch may be cut from an endless roll of laminar material and may be made for example from a suitable plastic like TPU, but also from textile materials, leather, artificial leather, cotton, etc.

As mentioned, in the example of FIGS. 1A to 1D, the patch 2 is to be applied to a last 1 which is a three-dimensional object. In general, some embodiments may be used for applying laminar components to a number of three-dimensional objects which may be preforms, such as three-dimensional uppers, or molds, such as the last 1 in the examples of FIGS. 1A to 1D. Other examples include applying patches, logos, or reinforcements to other parts of a shoe, such as a sole, or, to apparel, rackets, clubs, balls, etc.

In the examples of FIGS. 1A to 1D, the component, e.g., the patch 2, may be placed onto the last 1 via a first roll 4 while simultaneously moving the object relative to the roll 4. The first roll 4 may also be termed a contact roll 4. Thus, the last 1 may be moved in the direction of the arrow 5, while the first roll 4 rotates in the direction of the arrow 6. At the same time, the first roll 4 may exert some pressure on the patch 2 so that the patch is applied to the last 1. To this end, the patch 2 may have an adhesive side that causes the patch 2 to adhere to the last 1 or to a patch that had been applied to the last 1 in a previous operation.

Figure 1B:
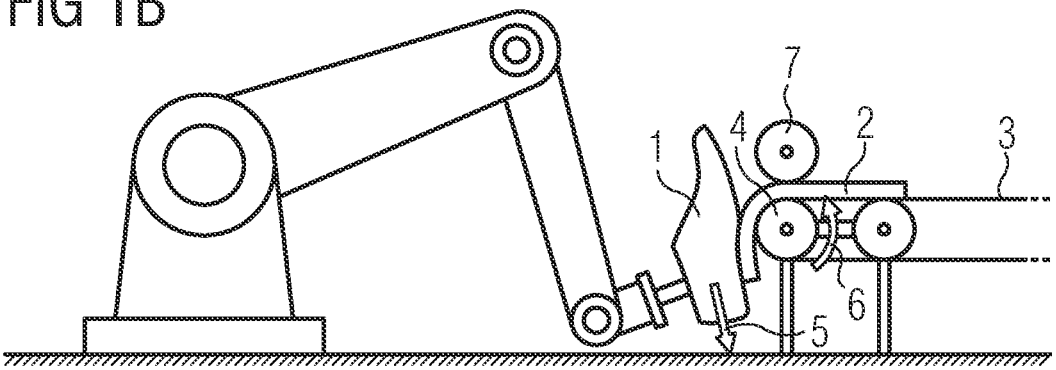

In some embodiments, as illustrated in FIG. 1A and FIG. 1B, the last 1 is moved by a robot arm. In some embodiments, as illustrated in FIG. 1A, the first roll 4 may be a pulley of the conveyor belt 3, e.g., the first roll 4 indirectly exerts pressure onto the patch 2 via the conveyor belt 3. As illustrated in FIG. 1B, a clamping roll 7 may be arranged above the first roll 4, which avoids that the patch 2 lifts off the conveyor belt 3 when it is placed onto the last 1. Additionally, this may allow strained components to be applied, as tensile force may be exerted on the component during application. Thus, the clamping roll 7 presses the patch 2 in the direction of the first roll 4. FIG. 1B shows an example in which a first portion of the patch 2 is clamped using the clamping roll 7 arranged relative to the first roll 4 while a second portion of the patch 2 is applied onto the shoe last 1. Instead of a clamping roll, an airflow or other mechanisms of constraining the patch may be used.

Figure 1C:
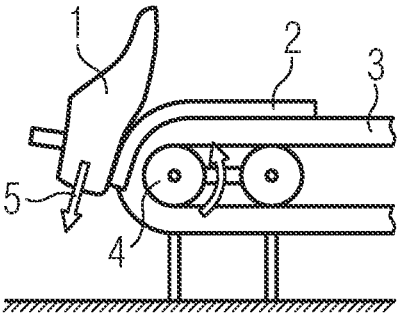
Figure 1D:
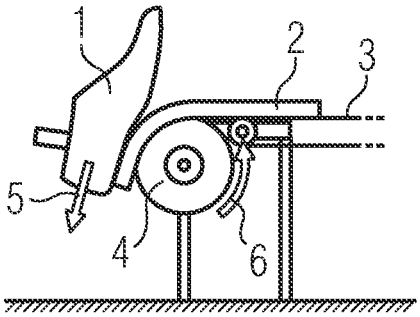

As illustrated in FIG. 1C, the first roll 4 may be a pulley of the conveyor belt 3. However, in some embodiments, the conveyor belt 3 may be compliant, e.g., it may yield so as to adapt to the surface contours of the last 1 onto which the patch 2 is to be placed. As such, the conveyor belt 3 in the example of FIG. 3C comprises a comparable soft surface. Finally, as illustrated in FIG. 1D, the patch 2 may be supplied to the first roll 4 by a conveyor belt 3 and the first roll 4 may be compliant, e.g., it may yield so as to adapt to the surface contours of the last 1 onto which the patch 2 is to be placed.

Figure 2A:
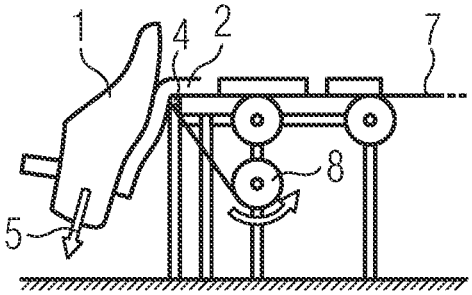
FIGS. 2A-2C are additional side views showing further examples of components that may be used in a method according to embodiments.
Figure 2B:
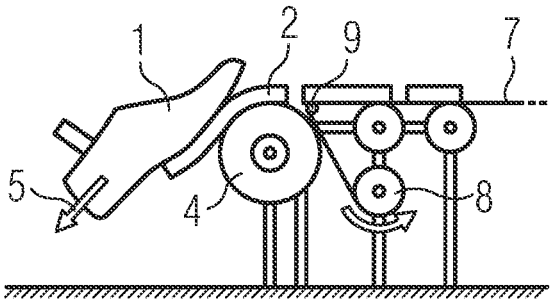
Figure 2C:
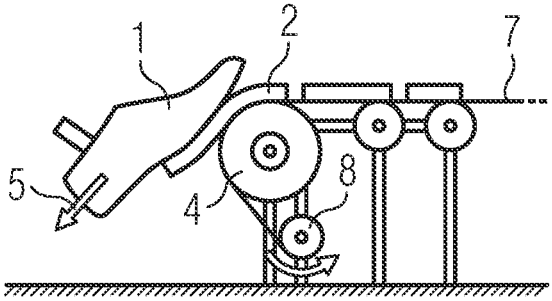

FIGS. 2A to 2C illustrate further alternative examples of a method according to a first aspect of some embodiments. According to these examples, the patch 2 is provided on a liner 7. The patch 2 adheres to the liner 7 by via a suitable adhesive. As shown in FIGS. 2A to 2C, a plurality of patches 2 may be provided on the liner 7 for example on an endless roll. Similarly, as illustrated in FIGS. 1A to 1D, the last 1 may be moved into the direction indicated by the arrow 5 when the patch 2 is applied to the last 1.

As illustrated in FIG. 2A, the liner 7 may be guided over the first roll 4. As the first roll 4 comprises a comparatively small diameter, the patch 2 may separate from the liner 7 and may be simultaneously placed onto the last 1. The liner 7 may then be wound up by a spindle 8.

As illustrated in FIG. 2B, the liner 7 may be guided over a second roll 9, which has a smaller diameter than the first roll 4, or may be a blade or a sharp edge. This may cause the patch 2 to separate from the liner 7 and be transferred to the first roll 4, which, in some embodiments, may be a compliant roll, as previously described. The patch 2 may then be transferred from the first roll 4 to the last 1 and placed thereon. Also in some embodiments, the liner 7 may then be wound up by a spindle 8.

The example illustrated in FIG. 2C may be similar to the example in FIG. 2A with the exception that the first roll 4 is compliant.

Figure 3A:
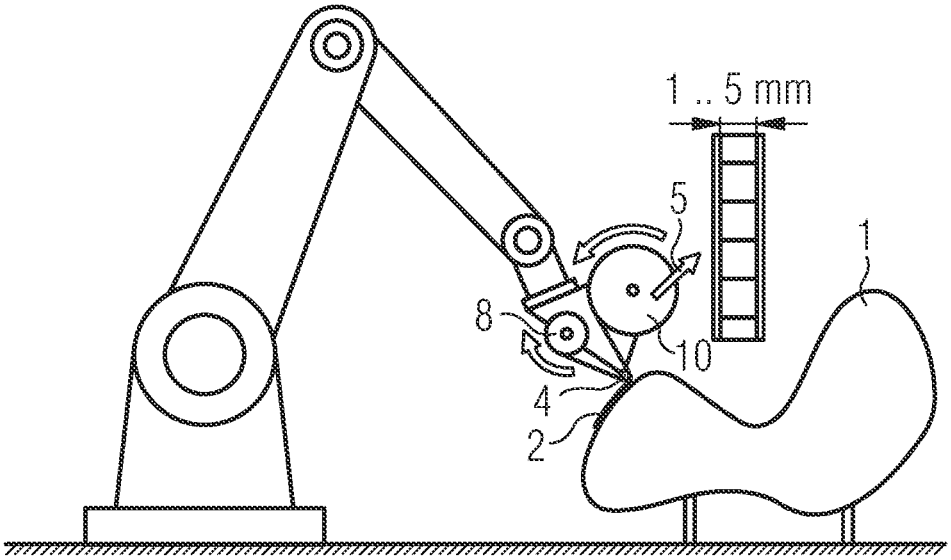
FIG. 3A is another side view showing further examples of components that may be used, such as in a method according to embodiments.
Figure 3B:
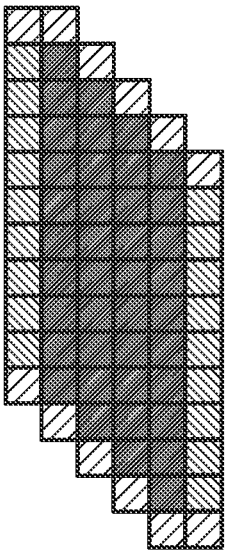
FIG. 3B is a side view showing an example of a result of the method of FIG. 3A according to embodiments.

FIGS. 3A and 3B illustrate a further example of a first aspect of some embodiments. In this example, the form 1 onto which the patch 2 is applied may be generally fixed. The first roll 4 may be mounted together with a supply roll 10 and a spindle 8 on a robot arm causing a relative movement between the first roll 4 and the form 1. The patch 2 may be supplied from the supply roll 10 on a liner. The liner may be guided over the first roll 4. As the first roll comprises a relatively small diameter, the component 2 may separate from the liner 7. The first roll 4 may exert pressure, such that the patch 2 is applied to the form 1. The liner may be wound up by the spindle 7. Simultaneously, the robot arm may move the first roll 4 into the direction indicated by the arrow 5.

As is also illustrated in FIG. 3A, the patches 2 may have a comparably small size with a characteristic dimension between 1 and 10 mm, which is relevant e.g., for footwear applications. Thus, a plurality of patches 2 may be applied to the form 1 to form a pattern, as illustrated in FIG. 3B, using overlapping patches. For other applications (e.g., placing patches on a torso), the characteristic dimension would be increased (e.g., up to 5 cm).

Figure 4A:
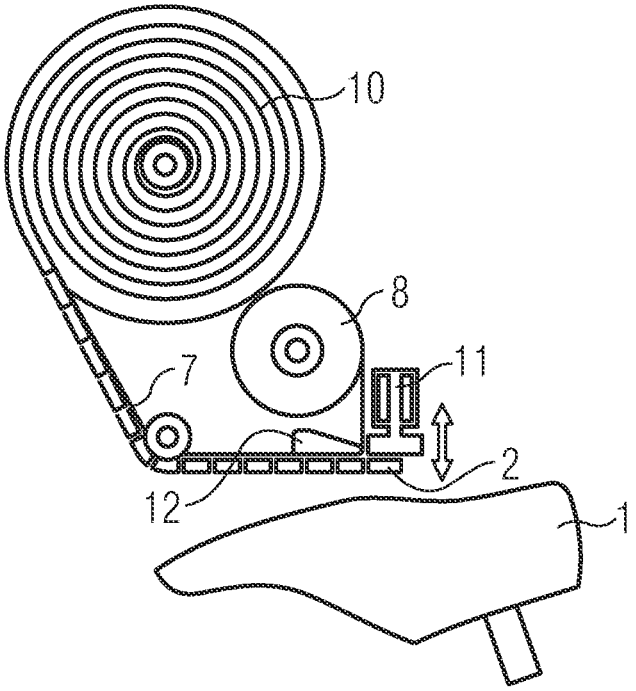
FIGS. 4A-4B are side views showing examples of components that may be used in methods according to embodiments.
Figure 4B:
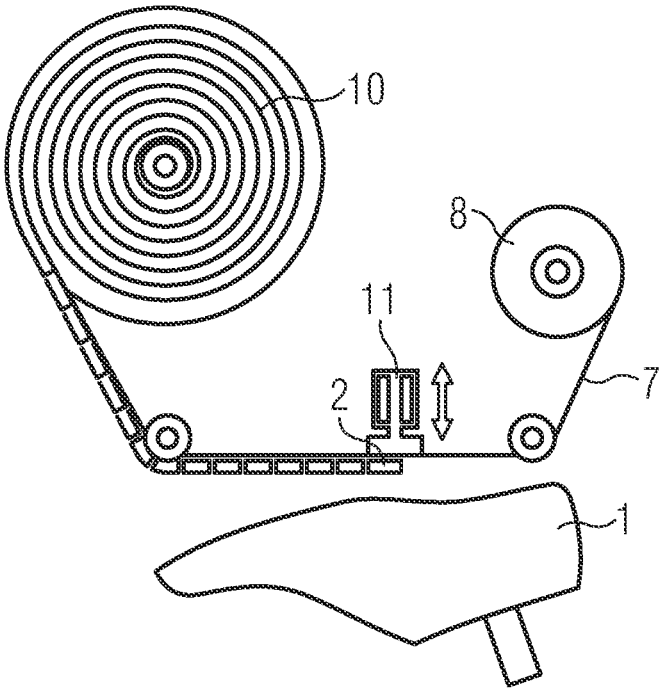

FIGS. 4A and 4B illustrate a method according to a some embodiments. According to some embodiments, for example, a method for the manufacture of a sports article, in particular a sport shoe, at least one laminar component 2 may be provided on a liner 7. The component 2 may adhere to the liner 7 by use of an adhesive. In the examples of FIGS. 4A and 4B, the component may be a patch 2 that is to be applied to a last 1 just like in the examples of FIGS. 1A to 1D and 2A to 2C. In the examples of FIGS. 4A and 4B, the placing of the patch 2 onto the last 1 may be caused by transferring the patch 2 from the liner 7 onto the last 1. This transfer may be effected by an electromagnetically actuated stamp 11, which pushes the patch 2 against the last 1. In some embodiments, a hotmelt is applied on one side of the patch. By heating the patch material, the hotmelt becomes sticky and then adheres to the last. Other application methods are possible, such as coating the patch and/or last with glue or using pressure activated glues.

In the example of FIG. 4A, the component 2 may be peeled off at an edge 12 from the liner 7 before it is transferred to the last 1 by the stamp 11, whereas in the example of FIG. 4B, peeling off the patch 2 may be omitted. Thus, in the example of FIG. 4B, the stamp 11 pushes both the liner 7 and the patch 2 adhering thereto into the direction of the last. In both examples of FIGS. 4A and 4B, a plurality of patches 2 may be supplied via a supply roll 10 and the liner 7 may be wound up by a spindle 8. Thus, also in the example of FIGS. 4A and 4B, a plurality of patches 2 may be applied to the form 1 to form a pattern as illustrated in FIG. 3B using overlapping patches.

Figure 5A:
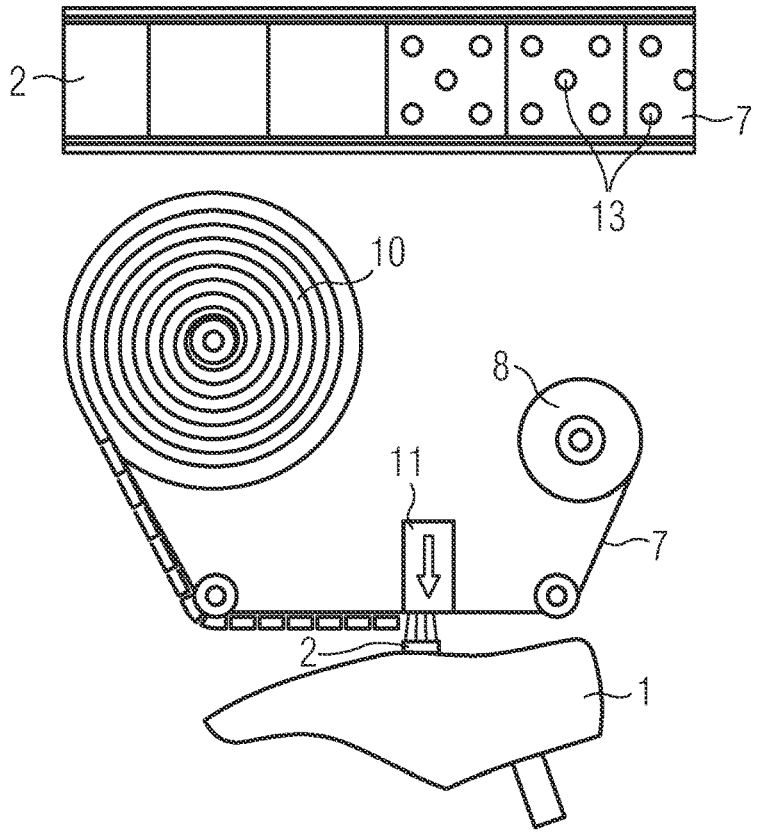
FIGS. 5A-5B are additional views showing examples of components that may be used in methods according to embodiments.
Figure 5B:
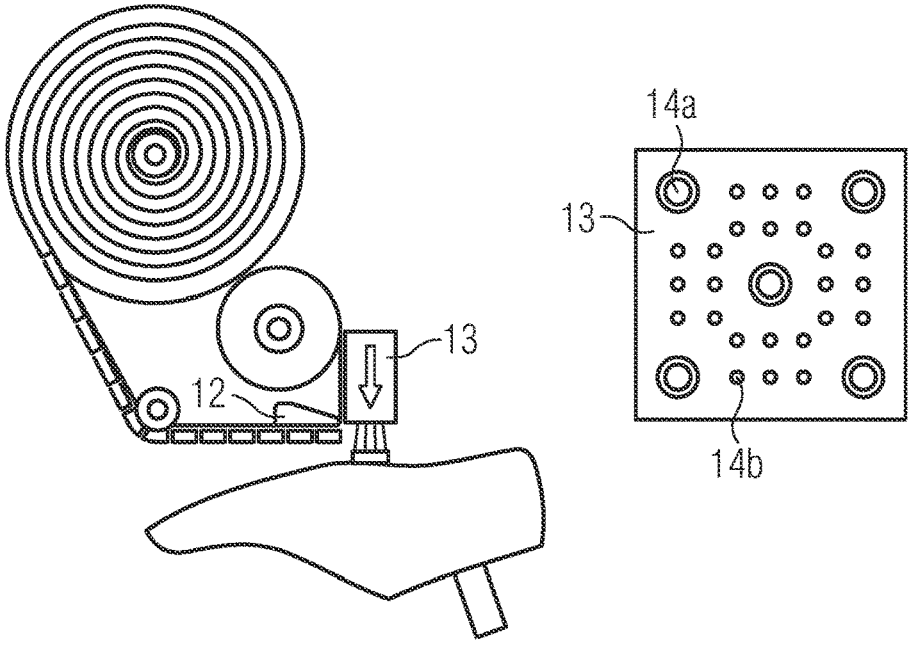

FIGS. 5A and 5B illustrate further examples of some embodiments. According to these examples, the patch 2 is transferred to the last 1 by an air blast (i.e., a short application of an airflow that pushes the patch 2 against the last 1). In the example of FIG. 5A, the liner 7 may be air permeable so that the air blast may be applied from one side of the liner to separate the patch 2 on the opposing side of the liner 7. To this end, the liner 7 in this example may comprise holes 13 as depicted in the upper half of FIG. 5A.

In the example of FIG. 5B, a standard (i.e., essentially non-air-permeable) liner 7 may be used. The patch 2 may be peeled off at an edge 12 to an air blast device 13. As shown on the right side of FIG. 5B, the air blast device 13 may comprise air blast holes 14*a* and low-pressure holes 14*b*. The air blast holes 14*a* may cause a transfer of the patch 2 into the direction of the last 1, whereas the low-pressure holes 14*b* may hold the patch 2 in place after peel-off and before the application of the air blast. In the example of FIG. 5B the air blast holes 14*a* may comprise a larger diameter than the low-pressure holes 14*b*.

Thus, also in the example of FIGS. 5A and 5B, a plurality of patches 2 may be applied to the form 1 to form a pattern as illustrated in FIG. 3B using overlapping patches.

Figure 6:
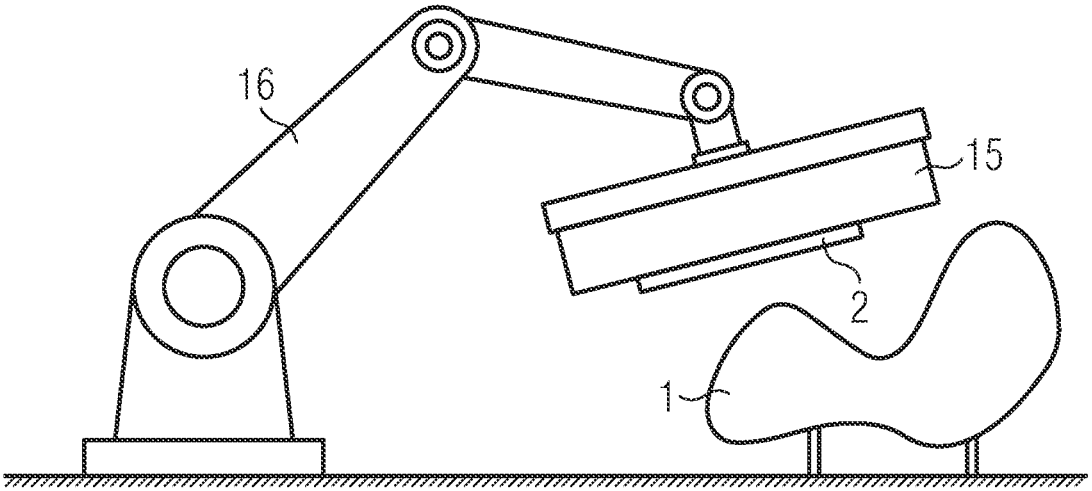
FIG. 6 is a side view further showing an example of a further aspect of some embodiments.

FIG. 6 illustrates an example of a further embodiments. According to this example, a component (i.e., a patch 2) is placed on a form-adaptive gripper 15. The gripper 15 may generally comprise a compliant surface, which is able to adapt to the three-dimensional shape of a form 1 onto which the patch 2 is to be applied. The gripper may generally be part of a robot arm 16, which may push the patch 2 against the form 1 so that the patch 2 is placed onto the form 1. Additionally, a roll-off motion may be performed to apply a patch 2 to more curved forms 1.

Figure 7:
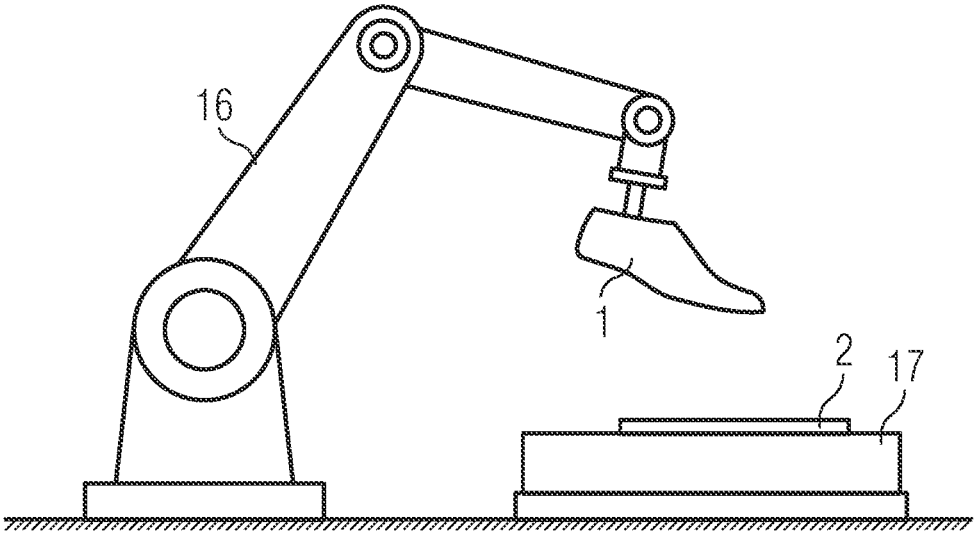
FIG. 7 is a side view further showing another example of a further aspect of some embodiments.

FIG. 7 illustrates another an example of further embodiments using a robot arm 16. In this example, a last 1 may be held by robot arm and pushed against a patch 2. The patch may be arranged on a form-adaptive table, which is compliant so that it may adapt to the shape of the last 1 so that the patch is applied to the last 1 with a more or less uniform force.

Figure 8A:
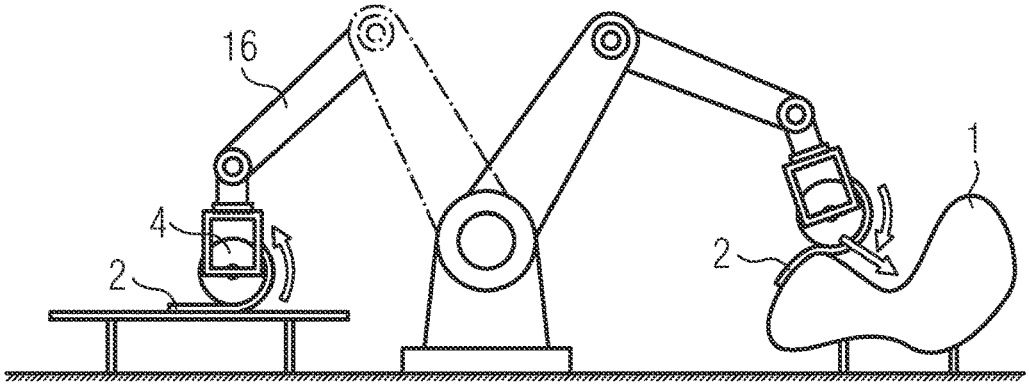
FIGS. 8A-8B are side views further showing examples of a further aspect of some embodiments.
Figure 8B:
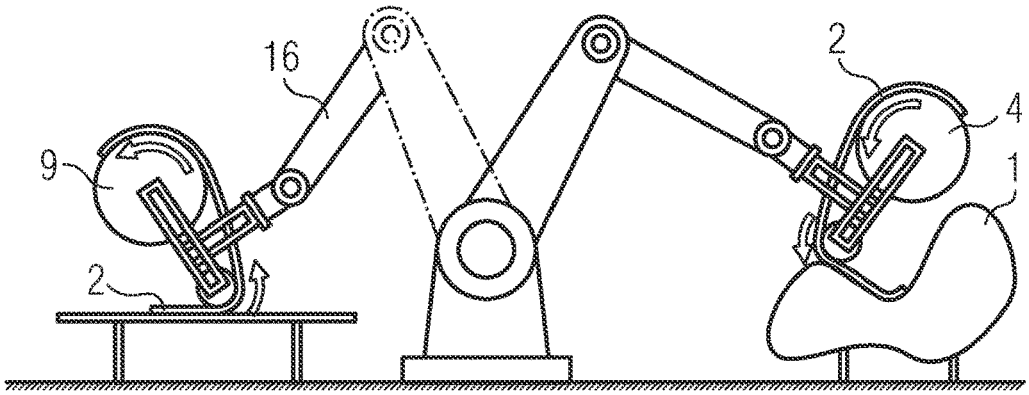

FIGS. 8A and 8B illustrate examples of further embodiments. In these examples, a roll-up end effector may be used, which is mounted on a robot arm 16. The end effector picks up a patch 2 via a roll 4. The patch 2 may then be placed onto a form 1 by the roll 4 while simultaneously moving the roll 4 relative to the form 1 in a direction such that the patch 2 is laid along the surface of the form 1. In the example of FIG. 8B, a larger, second roll 9 may be used to store a patch 2 by wrapping it around this second roll. Using the second roll 9, a longer patch 2 may be stored without having the patch 2 adhere to itself. This example is flexible and allows for a precise placement of the patch 2.

Figure 9:
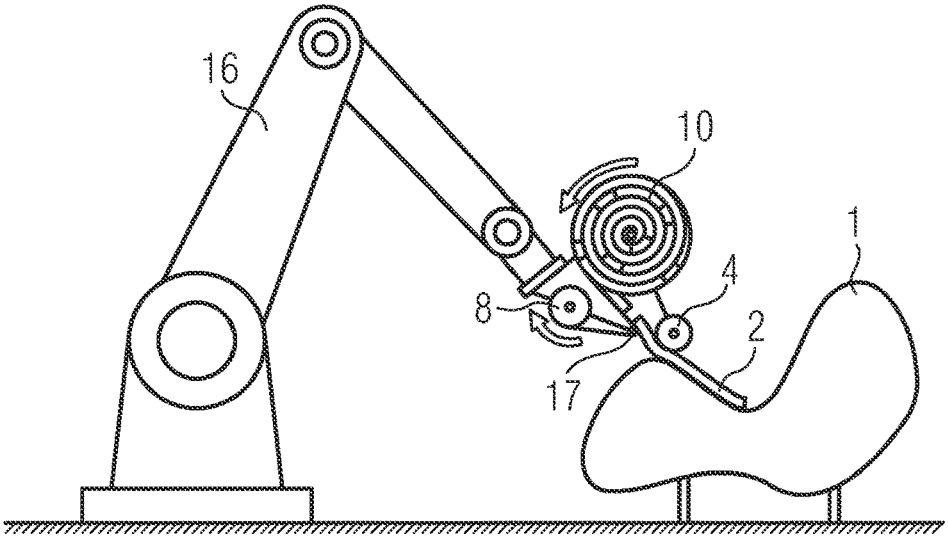
FIG. 9 is a side view further showing an example of a further aspect of some embodiments.

FIG. 9 illustrates an example of a further aspect of some embodiments. In this example, a dispenser end effector may be mounted on a robot arm 16. The dispenser may comprise a first roll 4, a supply roll 10 from which at least one patch 2 on a liner 7 is supplied, a spindle 8 to wind up the liner 7, and a small roll 17 to separate the patch 2 from the liner 7. The first roll 4 in this example may be compliant to adapt to the surface of a form 1 onto which the patch 2 is to be placed. While the patch is transferred from the first roll 4 to the form 1, the robot arm 16 may move the end effector relative to the form 1. The supply roll 10 in this example may be prepared, such that the patches 2 supplied from the roll 10 have the desired shapes and/or lengths and/or colors, etc. in the course of the application process. For example, if a number of different colored patches 2 is to be applied, the patches 2 may be pre-arranged on a single roll 10 in the correct sequence instead of having a separate roll for each color. This example is equally applicable to the shapes, sizes, materials, etc. of the patches 2.

Figure 10:
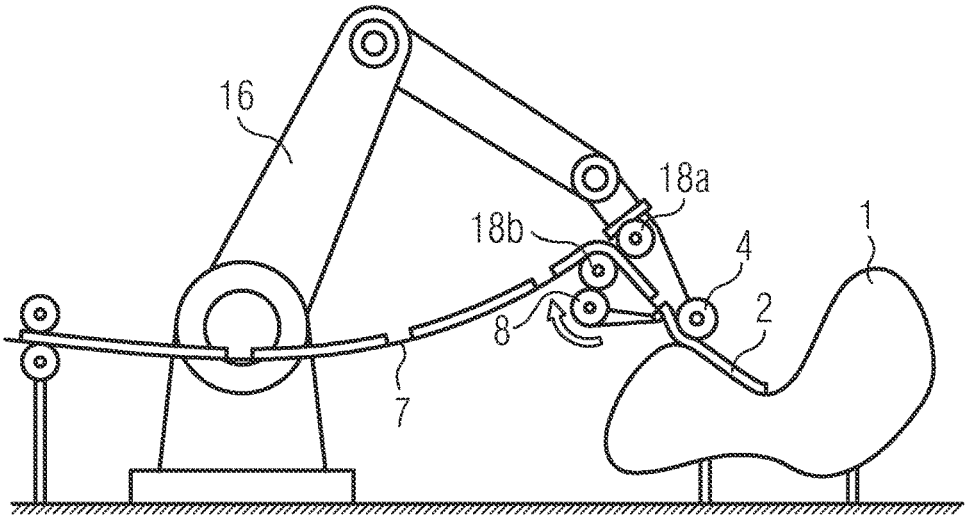
FIG. 10 is a side view further showing an example of a further aspect of some embodiments.

FIG. 10 illustrates an example of a further aspect of some embodiments. In this example, a patch 2 may be applied to a form 1 by a roll 4, which is mounted on a robot arm 16. The patch 2 may be supplied to the roll 4 on a liner 7. Unlike in the example of FIG. 9, the liner with a plurality of patches 2 thereon may be supplied from a stationary supply, which is not mounted on a robot arm. The liner 7 may be guided by a small roll 17 to separate the patch 2 from the liner 7. Subsequently, the patch 2 may be supplied to the roll 4 and then placed onto the form 1. The liner 7 may be clamped between two rolls 18*a* and 18*b*, which move the liner 7 by rotation.

Figure 11A:
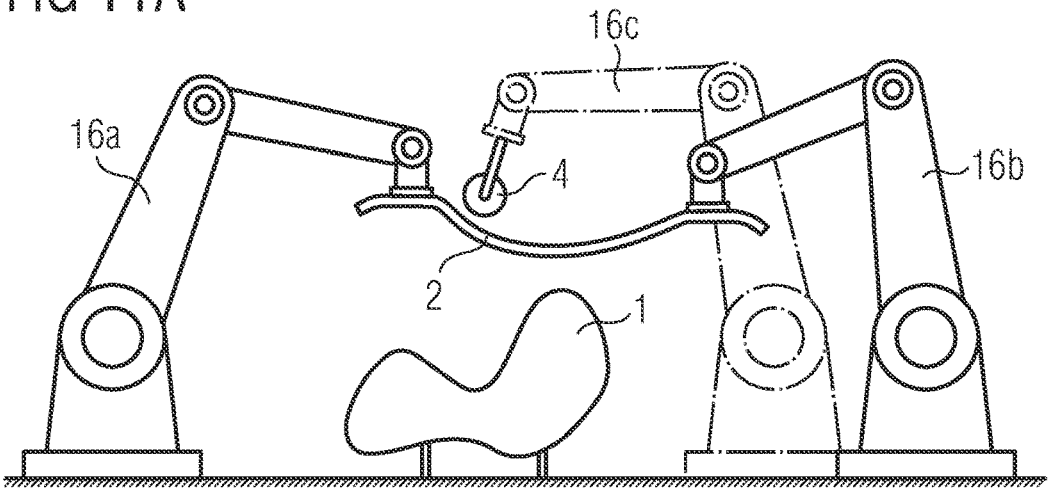
FIGS. 11A-11B are side views further showing examples of a further aspect of some embodiments.
Figure 11B:
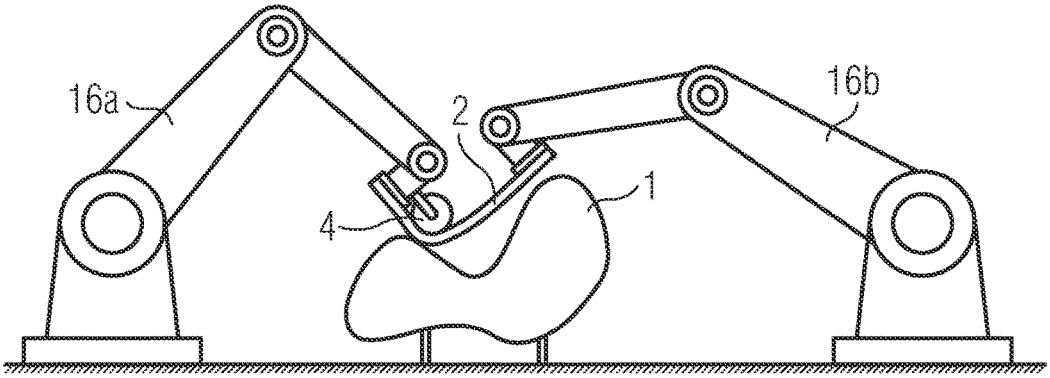

FIGS. 11A and 11B illustrate examples of a further aspect of some embodiments. In the example of FIG. 11A a first robot arm 16*a* holds a left end of a patch 2 to be applied to a form 1 via a first gripper. A second robot arm 16*b* holds a right end of the patch 2 via a second gripper. The patch 2 may adhere to the grippers via a vacuum. The grippers may also be clamp grippers or any other common mechanism. Both robot arms 16*a* and 16*b* may perform a coordinated movement to lay the patch 2 onto the form 1. This coordination may involve force-control to apply defined strip tension. Finally, a third robot arm 16*c* equipped with a draping roll 4 may press the patch 2 against the form 1 so that the patch is finally placed onto the form 1 and fixed. During this process, the third robot arm 16*c* may apply the component 2 with defined normal force using force-control. The exemplary method of FIG. 11A is precise and versatile and may also be used for curved patches or strips. The example may be realized via industry standard components and may be implemented on a three-armed gantry with each arm having two degrees of freedom. The example is scalable with respect to the shape of the object 1, the length, and material of the patches or tapes, respectively, to be placed onto the form or object 1. The smallest radius of curvature of the object 1 in this example may be given by the diameter of the draping roll 4. The normal and tension forces applied to the patch or tape 2 during lay-up may be defined.

FIG. 11B illustrates a variation of the example in FIG. 11A in which the number of robot arms may be reduced to two by combining the draping roll 4 with the gripper in one robot.

Figure 12A:
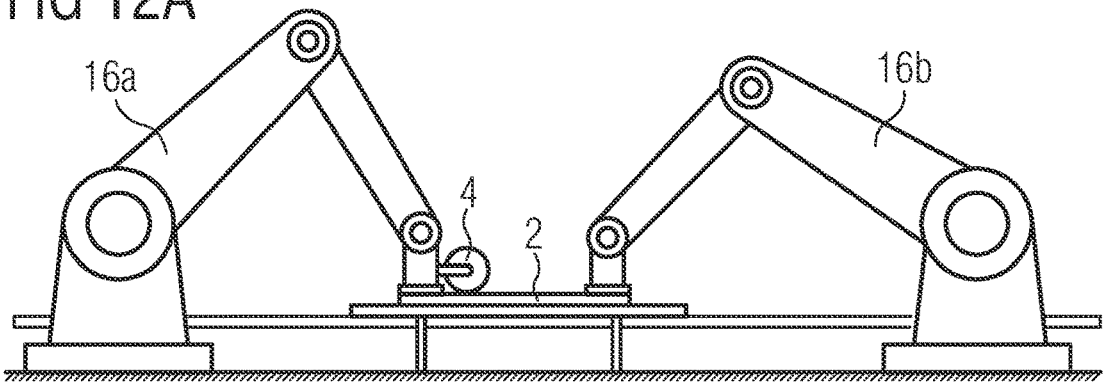
FIGS. 12A-12G are side views that further illustrate the example of FIG. 11B as a sequence of operations in time.
Figure 12B:
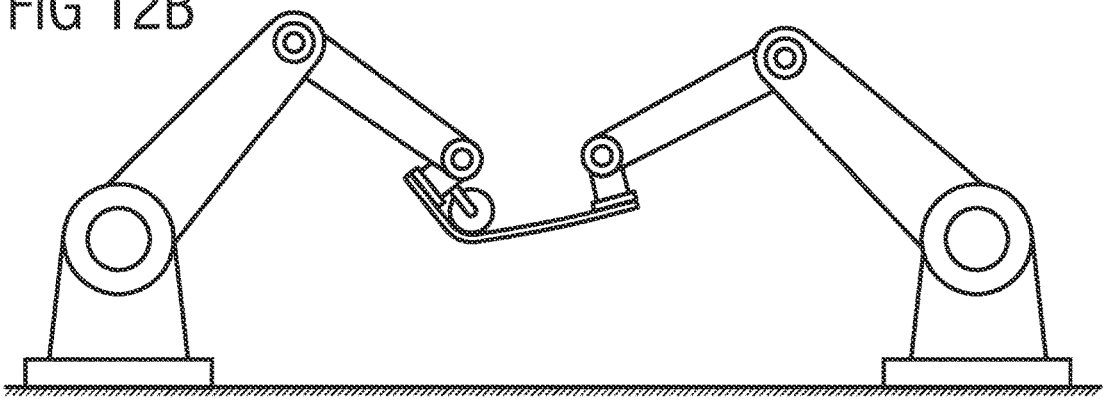
Figure 12C:
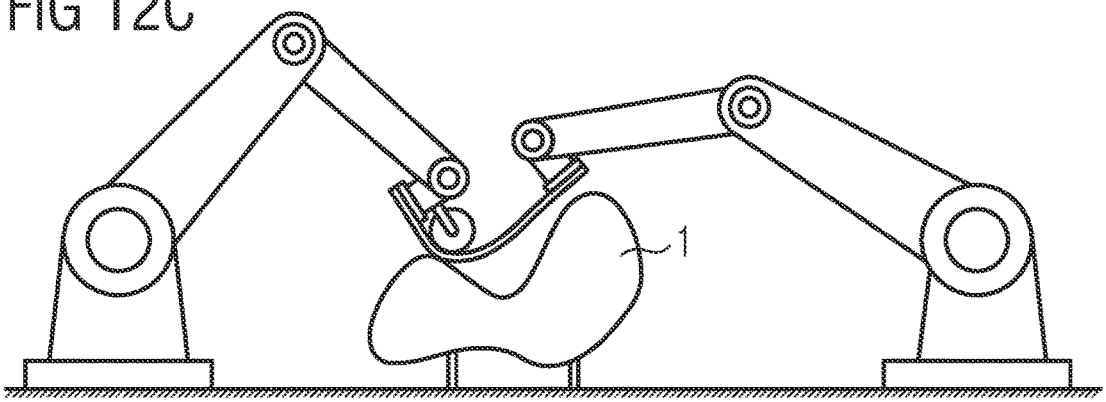
Figure 12D:
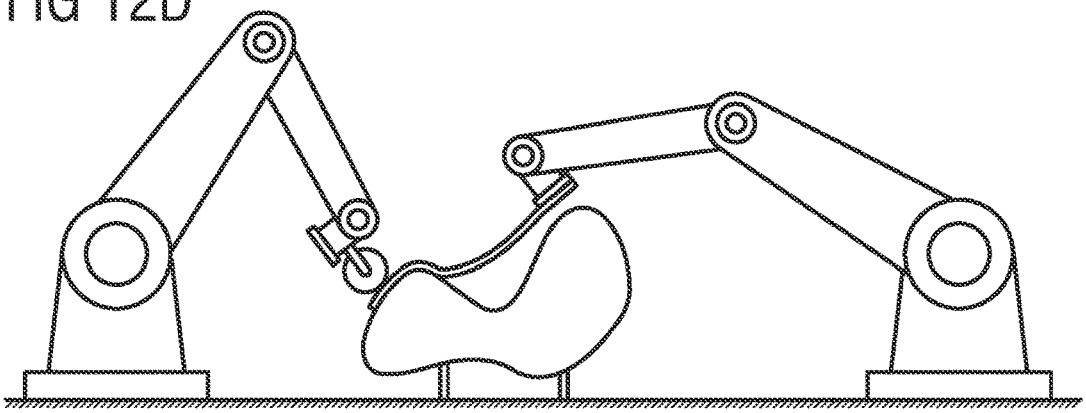
Figure 12E:
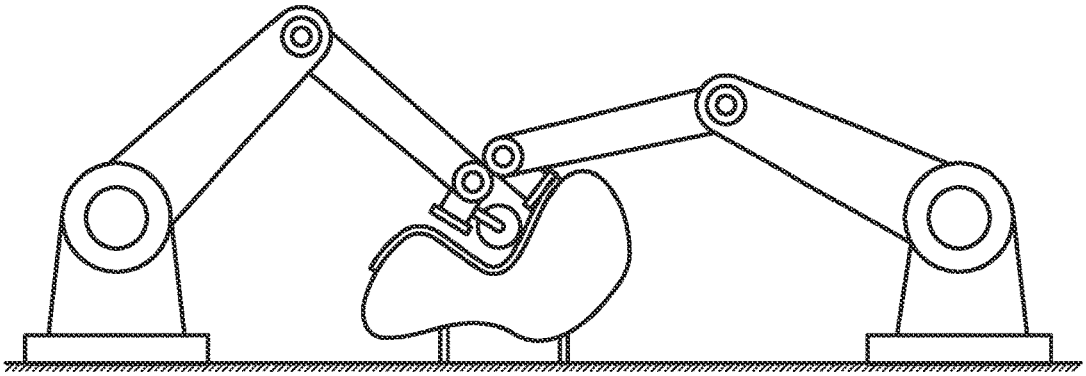
Figure 12F:
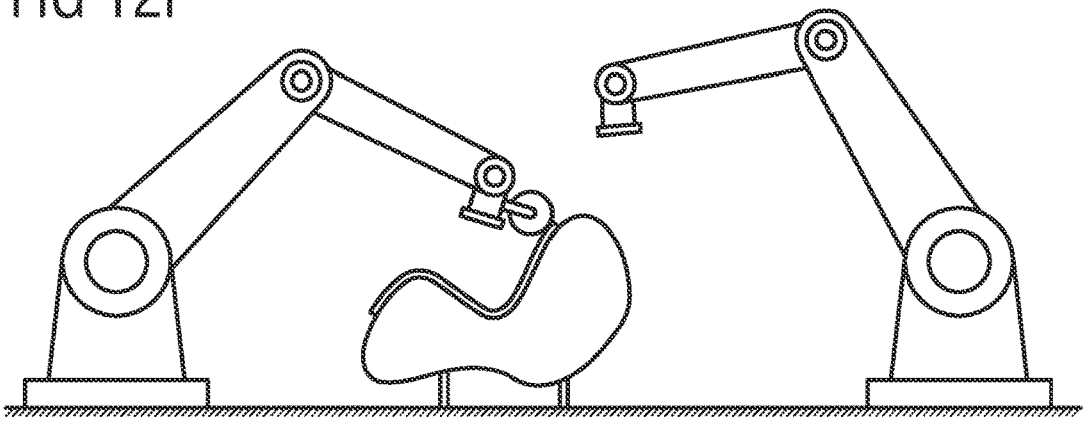
Figure 12G:
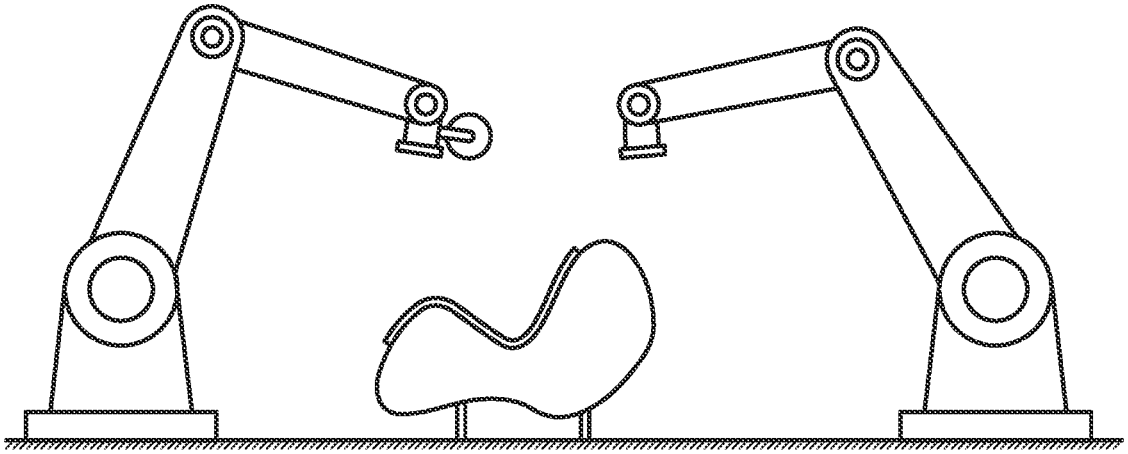

FIGS. 12A to 12G illustrate the example of FIG. 11B as a sequence of operations in time. In FIG. 12A, a patch or tape 2 may be picked up by the two robot arms 16*a* and 16*b*. The patch, or tape 2, may be provided on a table, which, after pick-up, may be moved away as shown in FIG. 12B. Instead of a table, a conveyor belt, or any other type of surface, may be used. Then, a three-dimensional object 1 may be provided between the robot arms 16*a* and 16*b*. Through coordinated motion and control, the robot arms 16*a* and 16*b* may transport the tape 2 to the object 1 and establish first contact using defined forces and the draping roll 4 mounted on the first robot arm 16*a*, as shown in FIG. 12C. The gripper of robot arm 16*a* may be released and the short end of the tape 2 may be applied onto the object 1, as shown in FIG. 12D. The patch, or tape 2, may then be pressed against the object 1 via a draping roll 4 mounted on the first robot arm 16*a* and thus placed onto the object 1 and fixed as shown in FIG. 12E. In FIG. 12F the second robot arm 16*b* has moved away from the object 1 so that the draping roll 4 on the first robot arm 16*a* may reach the long end of the patch or tape 2. Finally, in FIG. 12G, the patch, or tape 2, has been placed onto the object 1 and both robot arms have moved away from the object 1.

Figure 13:
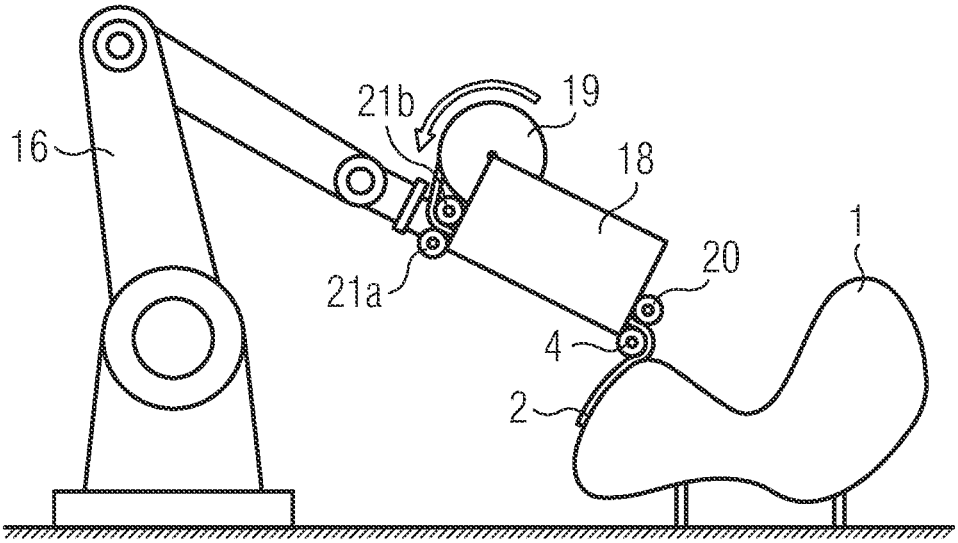
FIG. 13 is a side view further showing an example of a further aspect of some embodiments.

FIG. 13 illustrates an example of a further aspect of some embodiments with a contouring end effector 18 mounted on a robot arm 16. The end effector 18 may comprise a supply roll 19 of patch material and rolls 4, 20, 21*a*, and 21*b*. The rolls 21*a* and 21*b* may unwind the patch material from the supply roll 19. The rolls 4 and 20 may supply the patch material to an object 1 so that a patch 2 is applied to the object 1. The roll 4 may also exert pressure to the patch 2 so that it is placed onto the object 1.

Figure 14A:
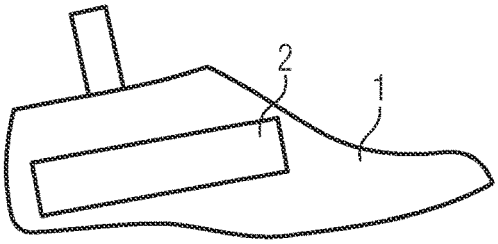
FIGS. 14A-14C are side views of examples of operations of contouring a laminar component applied to an object according to embodiments.
Figure 14B:
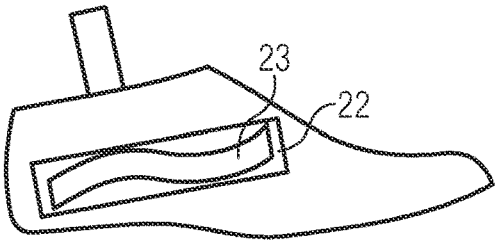
Figure 14C:
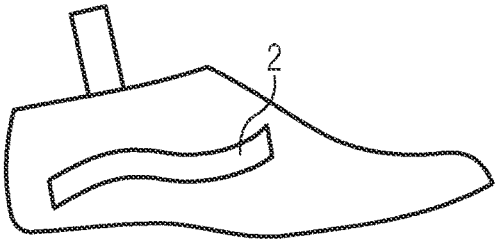

FIGS. 14A to 14C illustrate how a laminar component 2 applied to an object 1 may be contoured. In this example, the laminar component 2 may be a patch and the object may be a last. However, this example is not limited to a patch and a last and may, for example, also be applied for contouring a logo on an apparel. A shown in FIG. 14A, the patch 2 may be applied to the last by one of the methods described herein. FIG. 14B shows the contour 22 that the patch 2 may have on the final product. Excess material 23 may then be cut away from the patch 2 via a knife, laser or hot wire, etc. to obtain a contoured patch 2 as shown in FIG. 14C.

Figure 15:
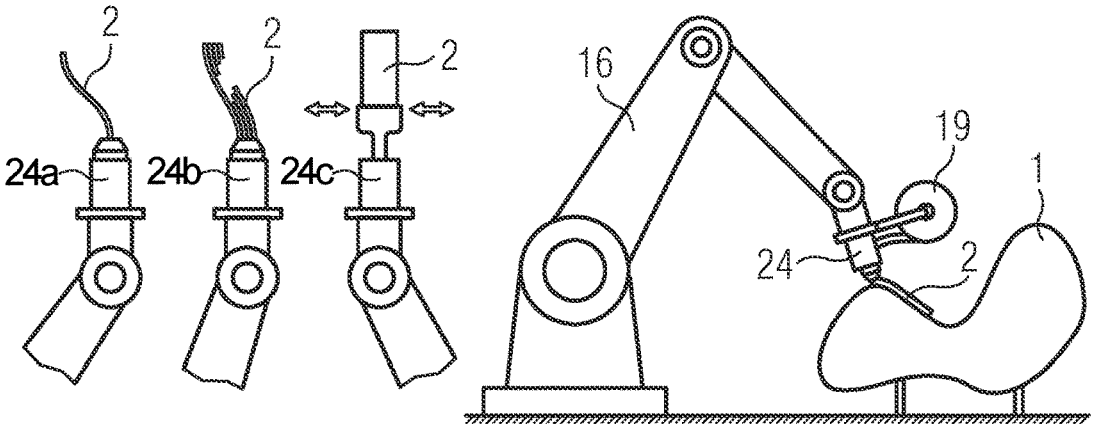
FIG. 15 is a view showing an example of applying a laminar component to a three-dimensional object via an additive manufacturing process according to embodiments.

FIG. 15 illustrates an example of applying a laminar component 2 to a three-dimensional object 1 via an additive manufacturing process, such as 3D-printing. This type of process is often known as Fused Deposition Modelling (FDM). As shown on the left of FIG. 15, the component material may be applied line-wise. The printhead 24 in this example may be mounted on a robot arm 16, which moves the printhead 24 over the surface of the three-dimensional object 1. Material may be provided to the printhead 24 via a supply roll 19. The printhead may use different mechanisms of applying material onto the object 1. Examples are printheads 24*a*, 24*b*, and 24*c*. Printhead 24*a* may extrude a linear stream of material 2*a* onto the object 1. Printhead 24*b* may provide multiple linear streams of material 2*b*, which can be switched on or off individually. Printhead 24*c* may extrude an aerial stream of material 2*c*, whereas the width of this stream may be continuously adjusted.

In the following, further examples are described to facilitate the understanding of the invention:

Example 1. Method for the manufacture of a sports article, in particular a sport shoe, comprising the steps:

a. providing at least one laminar component;
b. providing at least one three-dimensional object;
c. placing the component onto the object by means of a first roll while simultaneously moving the object relative to the roll.

Example 2. Method of example 1, further comprising the step of placing the component on a conveyor belt.

Example 3. Method of example 2, wherein the first roll is a pulley of the conveyor belt.

Example 4. Method of example 2, wherein the conveyor belt conveys the component to the first roll.

Example 5. Method of one of examples 2-4, wherein the conveyor belt is compliant.

Example 6. Method of one of examples 1-5, further comprising the step of pressing the component in the direction of the first roll.

Example 7. Method of example 1, wherein the step of providing the component comprises providing the component on a liner.

Example 8. Method of example 7, further comprising the step of guiding the liner over the first roll, such that the component separates from the liner.

Example 9. Method of example 7, further comprising the step of guiding the liner over a second roll, such that the component separates from the liner and is transferred to the first roll.

Example 10. Method of one of examples 1-9, wherein the first roll is compliant.

Example 11. Method for the manufacture of a sports article, in particular a sport shoe, comprising the steps:

a. providing at least one laminar component on a liner;
b. providing at least one three-dimensional object;
c. placing the component onto the object by transferring the component from the liner onto the object.

Example 12. Method of example 11, wherein the step of placing the component comprises pushing the component into the direction of the object.

Example 13. Method of example 12, further comprising the step of pushing the component into the direction of the object by means of an air blast, such that the component is placed onto the object.

Example 14. Method of example 13, further comprising the step of holding the component by low pressure before it is placed onto the object.

Example 15. Method of one of examples 11-14, further comprising the step of peeling off the component from the liner before pushing the component.

Example 16. Method of example 12, further comprising the step of pushing the liner in the direction of the object, such that the component is transferred from the liner onto the object.

Example 17. Method of one of examples 11 or 12, wherein the liner is air permeable and the method further comprises pushing the component into the direction of the object by means of an air blast, such that the component separates from the liner and is placed onto the object.

Example 18. Method of one of examples 1-17, further comprising the step of placing the component on a robot arm.

Example 19. Method of one of the examples 1-18, wherein the first roll is mounted on a robot arm.

Example 20. Method of one of examples 1-19, wherein the component comprises an adhesive.

Example 21. Method of one of examples 1-20, wherein the object is a shoe last.

Example 22. Method of one of examples 1-20, wherein the object is a preformed component of the sports article.

Example 23. Sports article which has been manufactured by use of a method according to one of examples 1-22.

Different arrangements of the components depicted in the drawings or described above, as well as components and steps not shown or described are possible. Similarly, some features and sub-combinations are useful and may be employed without reference to other features and sub-combinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications may be made without departing from the scope of the claims below.

That which is claimed is:

1. A method for the manufacture of a sports shoe or another sports article, the method comprising:

a) providing at least one laminar component;

b) placing the at least one laminar component on a conveyor belt, wherein the conveyor belt conveys the at least one laminar component to a first roll;

c) providing a three-dimensional object, wherein the three-dimensional object is a shoe last;

d) moving the shoe last using a robot arm, wherein the moving comprises positioning and orienting the shoe last in a first position and orientation relative to the laminar component conveyed by the first roll; and e) after the moving of the shoe last to the first position and orientation using the robot arm, placing the at least one laminar component onto the shoe last using the first roll, wherein placing the at least one laminar component onto the shoe last further comprises moving the robot arm such that the shoe last is simultaneously moved relative to rotating of the first roll.

2. The method of claim 1, wherein the first roll is a pulley of the conveyor belt.

3. The method of claim 1, wherein the conveyor belt is compliant.

4. The method of claim 1, further comprising pressing the at least one laminar component in a direction of the first roll.

5. The method of claim 1, wherein the first roll is compliant.

6. The method of claim 1, wherein the at least one laminar component comprises an adhesive.

7. A sports shoe which has been manufactured by use of a method according to claim 1.

8. The method of claim 1, further comprising clamping a first portion of the at least one laminar component using a clamping roll arranged relative to the first roll while a second portion of the at least one laminar component is applied onto the shoe last.

9. The method of claim 1, further comprising applying a tensile force on the at least one laminar component while placing the at least one laminar component onto the shoe last.

10. The method of claim 1, wherein placing the at least one laminar component onto the shoe last comprises placing the at least one laminar component on at least one of a concave surface or a convex contour of the shoe last.

* * * * *